United States Patent [19]

Fischer

[11] 4,219,252

[45] Aug. 26, 1980

[54] ELECTRIC PLUG CONNECTION

[76] Inventor: Karl Fischer, Am Gaensberg, 7519 Oberderdingen, Fed. Rep. of Germany

[21] Appl. No.: 960,674

[22] Filed: Nov. 14, 1978

[30] Foreign Application Priority Data

Nov. 23, 1977 [DE] Fed. Rep. of Germany ..... 2752194

[51] Int. Cl.[2] ..... H01R 13/16

[52] U.S. Cl. ..... 339/259 R

[58] Field of Search ..... 339/95 R, 259

[56] References Cited

U.S. PATENT DOCUMENTS

| | | | |
|---|---|---|---|
| 1,969,991 | 8/1934 | Robinson | 339/259 |
| 2,295,266 | 9/1942 | Obszarny | 339/95 R |
| 2,574,608 | 11/1951 | Ziph | 339/95 R |
| 2,654,076 | 9/1953 | Hudlow | 339/259 R |
| 3,914,008 | 10/1975 | Hollander et al. | 339/259 R |

FOREIGN PATENT DOCUMENTS

| | | | |
|---|---|---|---|
| 1431890 | 2/1966 | France | 339/259 R |
| 402474 | 12/1933 | United Kingdom | 339/259 R |
| 472945 | 10/1937 | United Kingdom | 339/259 R |
| 759534 | 10/1956 | United Kingdom | 339/259 R |

*Primary Examiner*—Joseph H. McGlynn

*Attorney, Agent, or Firm*—Steele, Gould & Fried

[57] ABSTRACT

An electric plug connection comprises a jaw-type connecting member in whose opening a conductor can be introduced and clamped. A hoop of sprung material is pushed over the connecting member, the two arms of the hoop pressing together the two arms of the connecting member. The hoop is formed as a sprung sheet metal member which is bent together along a back running parallel to its two arms.

13 Claims, 6 Drawing Figures

ELECTRIC PLUG CONNECTION

FIELD OF THE INVENTION

The invention relates to an electric plug connection, in particular for electric heating and cooker appliances with a jaw-type connecting member, in whose opening a connecting lead can be introduced and clamped, and in which a hoop of sprung material is pushed over the connecting member, the two arms of the hoop pressing together the two arms of the connecting member.

BACKGROUND OF THE INVENTION

Connecting members of this type have already been proposed in which the hoop consisted of a wire ring severed at one point, which was threaded through a hole and pressed with its two open ends on the two arms of the connecting member. A sprung hoop of this type has the advantage over a self-clamping connecting member, that it can be made of a very springy material which is not to be subjected to any demands with respect to conductivity. The proposed sprung hoop does, however, increase the size of the plug connection and is difficult to fit. In addition, its effectiveness is limited.

SUMMARY OF THE INVENTION

An object of the present invention is to provide an electric plug connection which is easier to produce and which ensures a good and secure connection while being of small size.

According to the invention there is provided an electric plug connection comprising a jaw-type connecting member in whose opening a conductor can be introduced and clamped, wherein a hoop of sprung material is pushed over the connecting member, two arms of the hoop pressing together two arms of the connecting member, the hoop being formed as a sprung sheet metal member which is bent together along a back running parallel to its two arms.

With this connection, the section of conductor to be inserted into the connecting member is thus surrounded on all sides by readily conductive material. The hoop can be produced from a spring material which still ensures a good spring effect even at high temperatures and is to be pushed on to the connecting member from the side as a substantially U-shaped member. The sprung hoop can receive an initial tension in two respects. On the one hand, the arms can be prestressed by bending them into the approximate shape of the arms of the connecting member, before the spring has been bent together along its back. This profiling can now produce a substantial initial tension of the arms when the hoop is subsequently bent together round its back. On the other hand, by means of suitable oblique positioning of the spring arms, allowance can be made for the fact that the base part of the spring is connected only on one longitudinal side and the spring effect is stronger there. It is also possible to mount the plug connection according to the invention automatically. It requires only a small amount of space but at the same time provides a very strong holding force.

An embodiment is shown in the accompanying drawings.

DETAILED DESCRIPTION OF PREFERRED EMBODIMENTS

Figure 1:
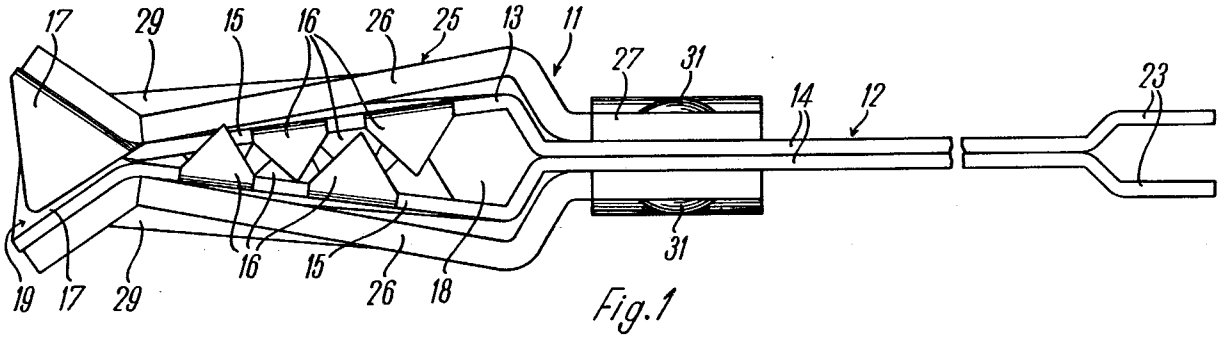
FIG. 1 shows an enlarged side view of a plug connection.
Figure 2:
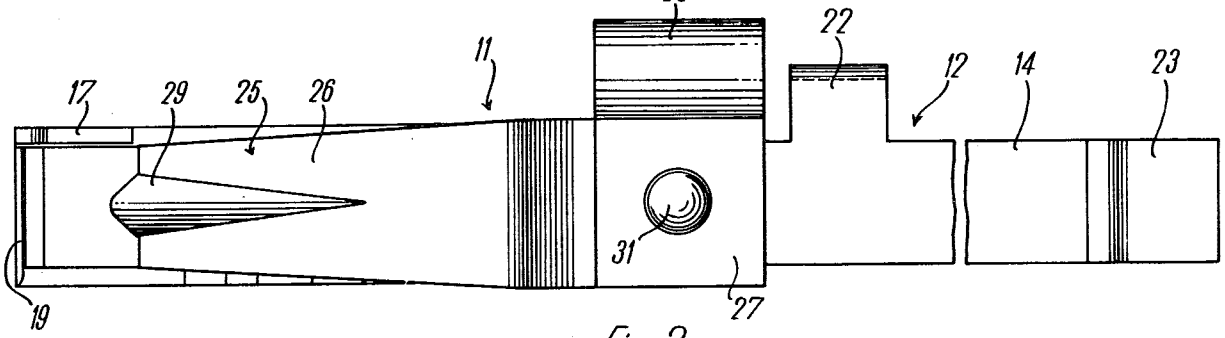
FIG. 2 shows a plan view of the plug connection.

FIGS. 1 to 4 show a plug connection 11 which comprises a connecting member 12 made of sheet metal which is a good conductor or which is coated with a material which is a good conductor. The actual connection section 13 is of a tulip-shape, in which the connecting jaw 18 is enclosed between two arms 15. The two arms form a funnel-shaped inlet opening in the region of the connecting opening 19. In the unused condition shown in FIG. 1, the two arms 15 are pressed together in the region of the connecting opening 19.

Teeth 16 are located in both longitudinal sides of the arms 15 and are offset to each other in each case, being orientated relative to each other and laterally covering the connecting jaw. These teeth 16 are formed by bending back tooth-like projections on the edges of the arms 15. Lateral members 17 are provided in the region of the funnel-shaped connecting opening 19, each of the lateral members 17 being arranged on one of the arms and covering one side of the connecting opening.

Figure 5:
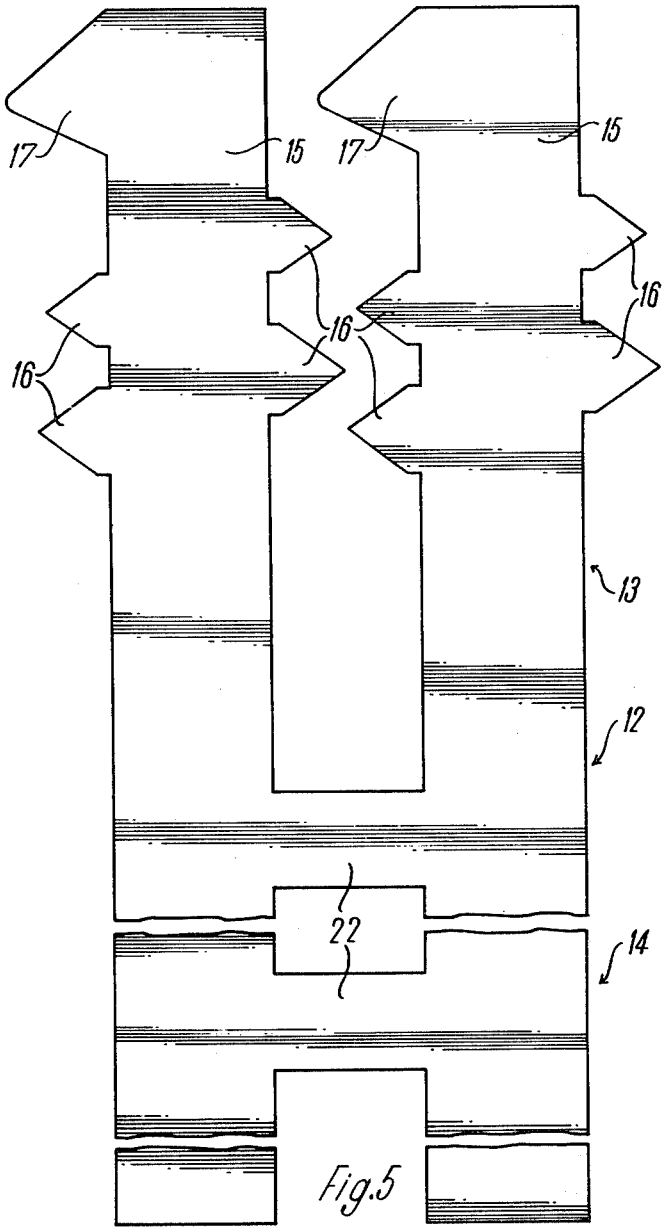
FIG. 5 shows in plan view a blank for a connecting member.

The connecting section of the connecting member 12 is integral with a section of the conductor 14 which consists of two superimposed strips of sheet metal which form the continuation of the arms 15. This extended section of conductor has a fork-shaped end 23 remote from the connecting section, and it is possible for its connecting pins to be welded to the fork-shaped end 23, for example in the case of a cooker plate. In the same way as the rest of the plug connection, the section of conductor lies in a suitable insulating housing, not shown here. The connecting member is produced as a sheet metal member from the blank illustrated in FIG. 5. The blank has a double-H or ladder-like shape, cross-members 22 of which form the arms (and in the extension thereof the two individual sections of the section of conductor). The steps of the ladder are formed by the cross-members 22, in the region of which the bending together with the connecting member takes place. The connecting member 12 is produced in such a way that the arms are bent into the desired shape and the teeth and side members are bent back first of all and the two arms are then folded back on each other by bending through 180° in the region of the cross-members 22.

A hoop 25 is pushed over the connecting section, the hoop 25 consisting of a spring material which can, if necessary, be substantially thicker than the material of the connecting member. The hoop has two arms 26 which run parallel to the arms 15 outside them and are substantially formed in a shape similar to arms 15. In the example shown, the arms 26 of the hoop 25 also have two end sections pointing obliquely outwards and adapted to the shape of the connecting opening. However, this is not essential since the hoop is mainly there in order to produce a clamping force in the region of the connecting jaw 18. The arrangement in which the ends of the hoop point obliquely outwards does, however, ensure that even if the connecting member is made of relatively thin material the connecting opening does not bend. The hoop has a fitting groove 29 which corresponds to the guide groove 21 of the connecting member, with which it centers itself on the connecting member.

Figure 3:
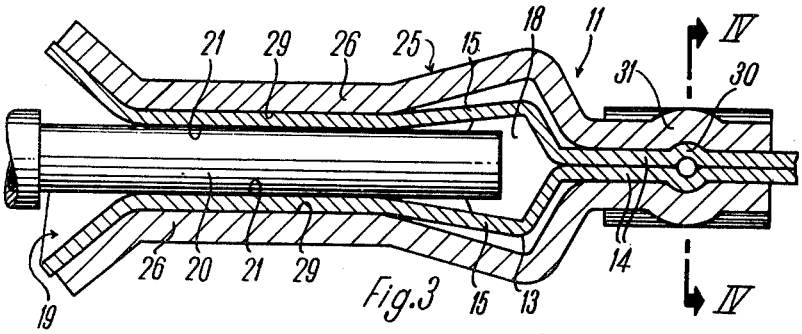
FIG. 3 shows a detailed longitudinal section with a connecting lead inserted.
Figure 4:
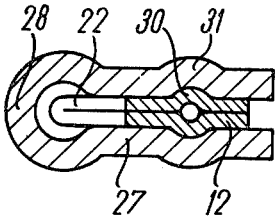
FIG. 4 shows a section along the line IV—IV in FIG. 3.
Figure 6:
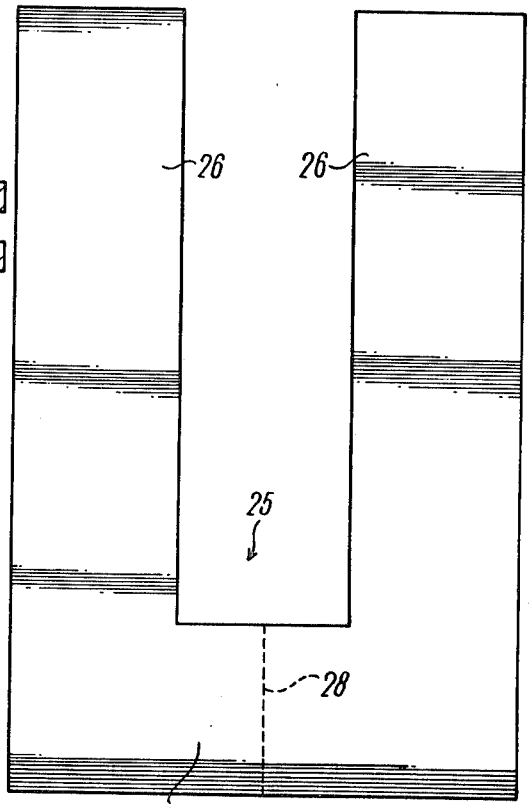
FIG. 6 shows, also in plan view, a blank for a spring member.

The hoop is produced from the blank shown in FIG. 6 which is a flat U-shaped sheet metal member, the two arms of which form the arms 26 and which is joined by means of a cross-member 27. After forming the tulip shape of the arms 26, the hoop is bent together round the back 28 in the region of the cross-member 27 to produce the shape, illustrated in FIGS. 1 to 4, of a hoop open on one of the longitudinal sides and joined on the other side by the rounded spring back 28. As shown in FIGS. 3 and 4, the cross-members 27 always press together the two arms of the connecting member 12 without either being opened, even as a result of insertion of the conductor. The hoop can be prestressed to allow the connecting members to press against each other with greater force by suitable shaping, i.e. by overemphasizing the contour of the arms 26 and optionally by means of an oblique position.

In the region of the cross-member 27, i.e. directly behind the end of the connecting jaw 18, the cross-member surrounds the conductor section 14 lying doubled and is centered there by a stamping 30 in the connecting member which mates with a corresponding stamping 31 in the hoop.

Both the connecting member and the hoop can thus be produced completely mechanically from flat blanks, be bent together and pushed on each other. They produce a small plug connection member with a large clamping force and good properties of conductivity, which is resistant to high temperatures. Particularly good contact with the connecting wires 20 can also be produced by roughening or corrugating its surface in the region of the connecting jaw, the connecting wires 20 not being cleaned very thoroughly when they are inserted. If in need of repair, the connecting wires 20 can be removed again, although against a sufficiently large resistance for secure fixing.

I claim:

1. An electric plug connection, comprising: a jaw-type connecting member, having an opening into which a conductor can be inserted and clamped, the connecting member having two arms and comprising a connecting section and an adjacent conductor section, being formed from a single sheet metal blank which is bent together, lying doubled over in the connecting section; and, a hoop of sprung material, pushed over the connecting member and having two arms pressing the connector member arms together, and a back, the hoop being formed from a sprung sheet metal member which is bent together along the back, parallel to its arms, the back of the hoop being shaped to form an arched cross member, lying in a region of the connecting section remote from the opening, the two connecting member arms lying parallel to each other and being steadily pressed together by direct contact with the cross member in the region, remaining together even during the insertion, the hoop arms further providing an initial tension pressing the connecting arms toward each other.

2. A plug connecting according to claim 1, wherein the hoop is of the same basic shape as the connecting member in the region of its arms and substantially covers them.

3. A plug connection according to claim 1, wherein the arch cross-member forming the back of the hoop projects beyond a longitudinal edge of the arms of the hoop and connecting member.

4. A plug connection according to claim 1, wherein the sheet metal blank for the connecting member is of a ladder-shaped configuration.

5. A plug connection according to claim 1, wherein the hoop is formed of a sheet metal blank having a U-shaped configuration.

6. A plug connection according to claim 1, wherein the connecting member and the hoop have intermeshing stamped projections and recesses for reciprocal positional security.

7. A plug connection according to claim 1, wherein the connecting member has intermeshing teeth on the longitudinal edges of its two arms.

8. A plug connection according to claim 1, wherein lateral members are provided adjacent sides of the opening in the connecting member, the lateral members each being integral with, and bent back from one of the arms.

9. A plug connection according to claim 1, wherein the connecting member arms have roughened or corrugated inner surfaces.

10. A plug connection according to claim 1, wherein the pressed together portions of the connecting member and hoop in the conductor section are joined together by respective arched cross-members.

11. A plug connection according to claim 10, wherein the cross-members project beyond a longitudinal edge of the strips.

12. A plug connection according to claim 1, wherein the connecting member has a guide groove merging into its inlet opening.

13. A plug connection according to claim 12, wherein the hoop has a configuration adapted to the said guide groove for positional security.

* * * * *